US006685504B1

(12) United States Patent
Espenshade

(10) Patent No.: US 6,685,504 B1
(45) Date of Patent: Feb. 3, 2004

(54) SHIELDED ELECTRICAL CONNECTOR ASSEMBLY HAVING RELIABLE GROUNDING CAPABILITIES

(75) Inventor: Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/234,567

(22) Filed: Sep. 3, 2002

(51) Int. Cl.[7] ..... H01R 13/60; H01R 13/648
(52) U.S. Cl. ..... 439/541.5; 439/607
(58) Field of Search ..... 439/607, 541.5, 439/609, 620

(56) References Cited

U.S. PATENT DOCUMENTS 5,647,767 A 7/1997 Scheer et al.
6,183,292 B1 2/2001 Chen et al.
6,478,610 B1 * 11/2002 Zhou et al. ..... 439/490

* cited by examiner

*Primary Examiner*—Hung V. Ngo
(74) *Attorney, Agent, or Firm*—Wei Te Chung

(57) ABSTRACT

An electrical connector assembly (1) includes an insulative main housing (2), a contact module (3), a daughter printed circuit board (PCB) (7) carrying a plurality of signal conditioning components (71) and a shield (8). The main housing defines a cavity (21) for receiving the contact module. The contact module includes a plurality of conductive terminals (32) electrically connecting with the daughter PCB. The daughter PCB includes a pair of contact pads (72) formed on opposite faces thereof. The shield defines a chamber (80) substantially enclosing the main housing and the daughter PCB therein. The shield includes two pairs of contacting legs (811) projecting into the chamber. Each pair of contacting legs clamp the daughter PCB therebetween and electrically connect connecting with corresponding contact pads of the daughter PCB.

20 Claims, 9 Drawing Sheets

SHIELDED ELECTRICAL CONNECTOR ASSEMBLY HAVING RELIABLE GROUNDING CAPABILITIES

CROSS-REFERENCE TO RELATED APPLICATION

The present application is related to a U.S. patent application entitled to "STACKED ELECTRICAL CONNECTOR ASSEMBLY HAVING EASILY DETACHABLE ELECTRONIC MODULE", and another application entitled to "STACKED CONNECTOR WITH REAR COVER ASSEMBLED THERETO", contemporaneously filed and assigned to the common assignee. Copies of the specifications are hereto attached.

BACKGROUND OF THE INVENTION

1. Field of the Invention

The present invention relates to an electrical connector assembly, and more particularly to an electrical connector assembly having reliable grounding capabilities.

2. Description of the Prior Art

In the electronics industry, electrical connectors are often mounted to printed circuit boards for electrical connection to circuit traces on the boards. The electrical connectors typically comprise housings, a plurality of contacts received in the housings and shields enclosing the housings for shielding against electromagnetic interference (EMI). In order to remove undesired noises, more and more electrical connectors tend to employ signal conditioning components.

U.S. Pat. No. 5,647,767 discloses a conventional electrical connector assembly 2. The electrical connector assembly 2 comprises an insulative housing 4, a metallic shield 92 enclosing the housing 4 and a signal conditioning printed circuit board (PCB) 36. The signal conditioning PCB 36 is received in the housing 4 with an exposed portion projecting out of the housing 4. It is desirable to connect the signal conditioning PCB 36 to ground. One method of grounding the signal conditioning PCB 36 is to attach directly a ground wire 50 to the exposed portion of the signal conditioning PCB 36. This method has problems in requiring a separate connecting operation and also is relatively complicated.

To solve above-mentioned problems, in one embodiment as disclosed in FIG. 8 of the '767 patent, the shield 92 forms a tab 94 outwardly bending. The tab 94 electrically connects with the exposed portion of the signal conditioning PCB 36. The shield 92 also has a plurality of mounting legs 96 which are soldered to a mother PCB 90. A continuous ground connection is thus established between the two PCBs 36 and 90. However, being exposed to outside, a connecting joint between the tab 94 of the shield 92 and the signal conditioning PCB 36 may be damaged by external forces and may break down after a period of use of the electrical connector assembly 2, resulting in an unreliable ground connection between the signal conditioning PCB 36 and the mother PCB 90.

Hence, an improved electrical connector assembly is required to overcome the disadvantages of the prior art.

BRIEF SUMMARY OF THE INVENTION

A main object of the present invention is to provide an electrical connector assembly having a shield which is capable of establishing a reliable grounding connection between the electrical connector assembly and a mother printed circuit board of an electrical device.

An electrical connector assembly in accordance with the present invention is mounted on a mother printed circuit board (PCB) of an electrical device. The electrical connector comprises an insulative main housing, a contact module, a daughter PCB and a shield. The main housing comprises opposite front and rear walls, and opposite sidewalls substantially perpendicular to the rear wall. The main housing defines a cavity for receiving the contact module. The contact module comprises a compensation PCB and a plurality of conductive terminals soldered on the compensation PCB. The daughter PCB is parallel to the rear wall of the main housing. The daughter PCB is electrically connected to the conductive terminals of the contact module. A pair of contact pads formed on opposite faces of the daughter PCB. The shield defines a chamber for shielding the main housing and the daughter PCB therein. The shield comprises two pairs of projecting contacting legs. The contacting legs clamp the daughter PCB and electrically connecting with corresponding contact pads of the daughter PCB. The shield also comprises a plurality of mounting legs soldered to ground traces on the mother PCB of the electrical device. A continuous ground connection is thus established between the daughter PCB and the mother PCB of the electrical device.

Other objects, advantages and novel features of the invention will become more apparent from the following detailed description when taken in conjunction with the accompanying drawings.

DETAILED DESCRIPTION OF THE INVENTION

Figure 1:
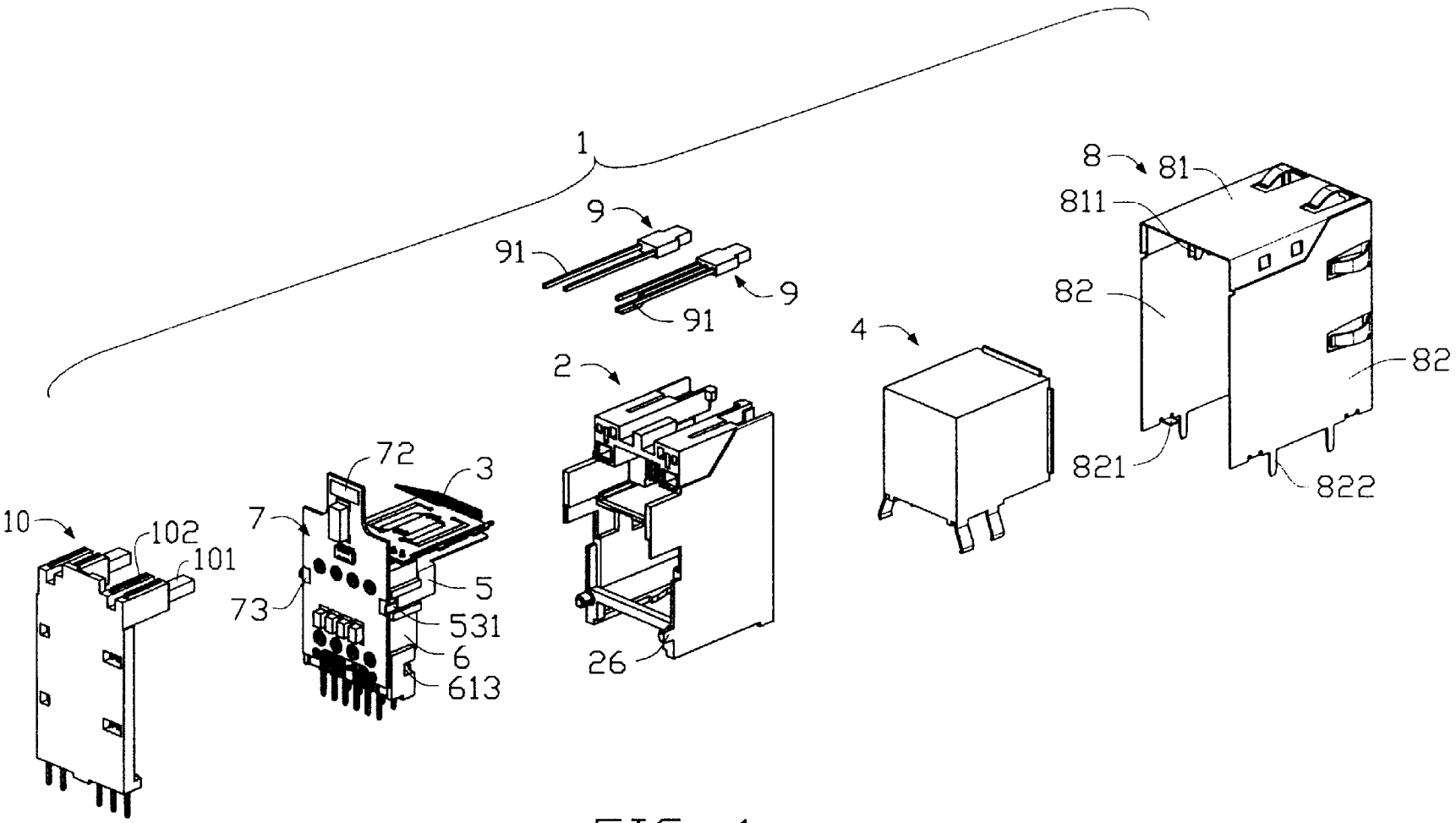
FIG. 1 is an exploded view of an electrical connector assembly according to the present invention.
Figure 2:
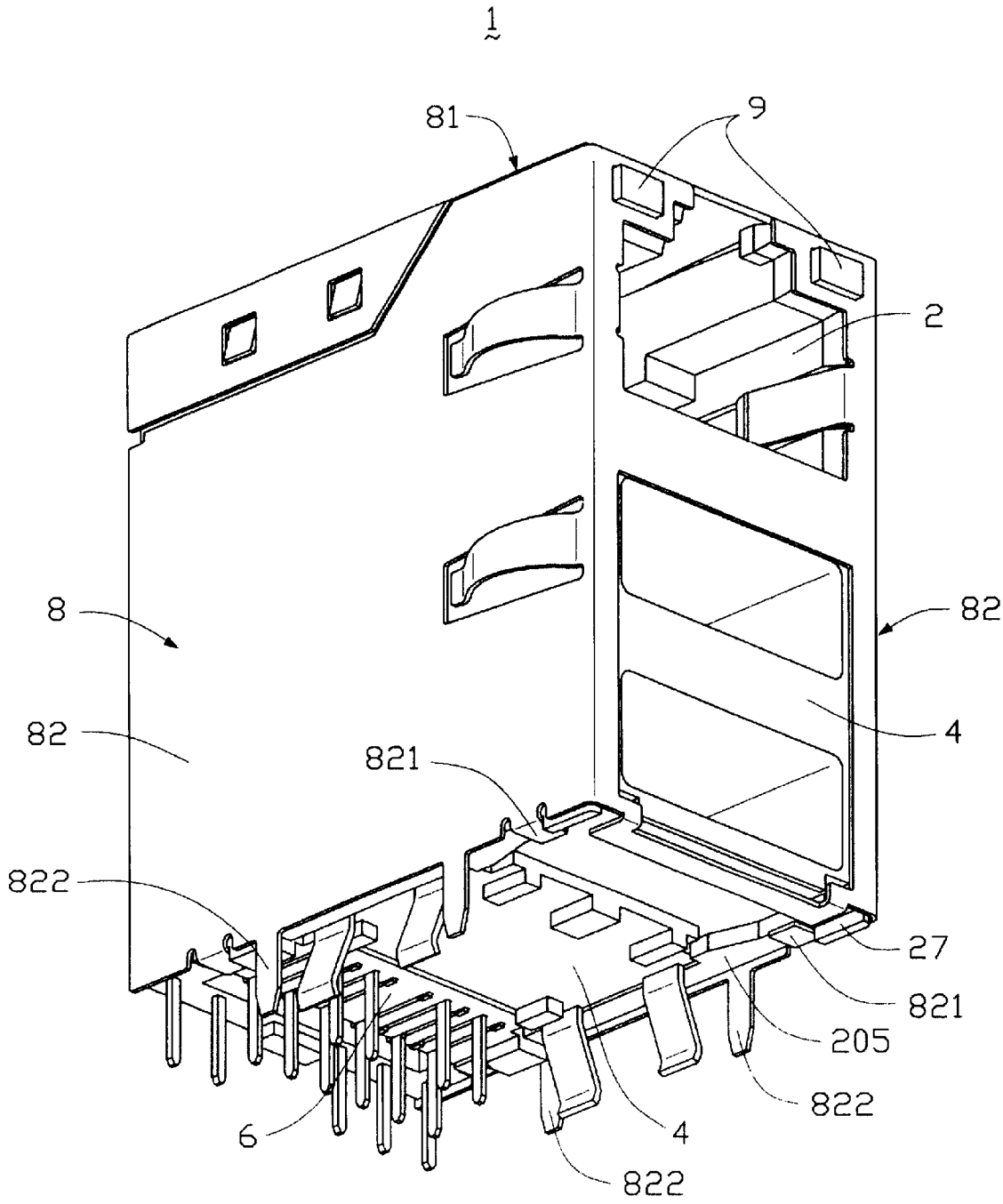
FIG. 2 is an assembled view of FIG. 1.
Figure 3:
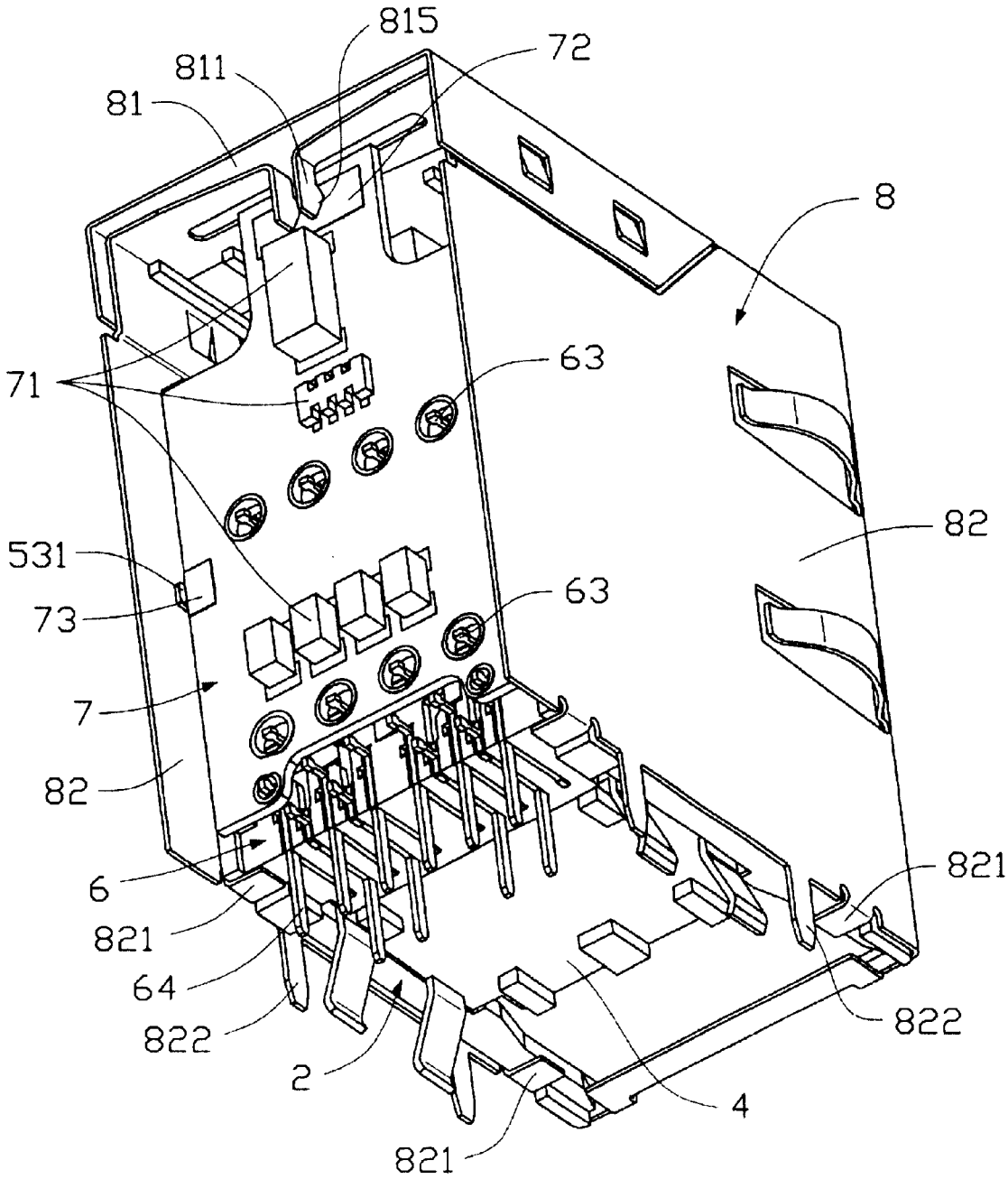
FIG. 3 is another assembled view of FIG. 1, with a rear cover removed for clarity.

Referring to FIGS. 1, 2 and 3, a stacked electrical connector assembly 1 according to the present invention comprises an insulative main housing 2, a contact module 3, a stacked Universal Serial Bus (USB) connector 4, a ground member 5, a magnetic module 6 mounted on the main housing 2, a daughter printed circuit board (PCB) 7 mounted on the magnetic module 6, a metallic shield 8 substantially enclosing the main housing 2, a pair of Light Emitting Diodes (LEDs) 9 and a rear cover 10.

Figure 4:
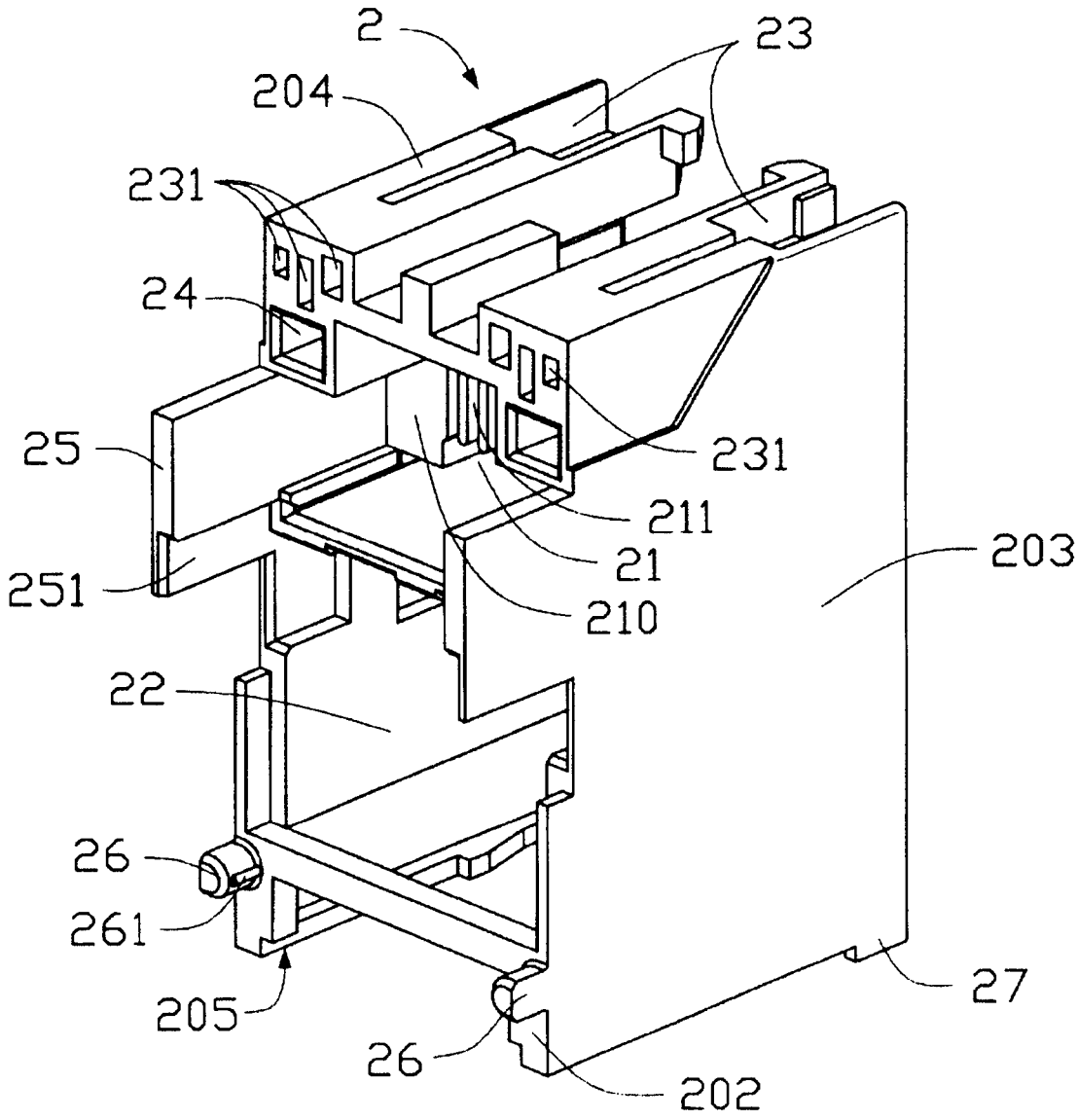
FIG. 4 is a perspective view of a main housing of the electrical connector assembly.
Figure 5:
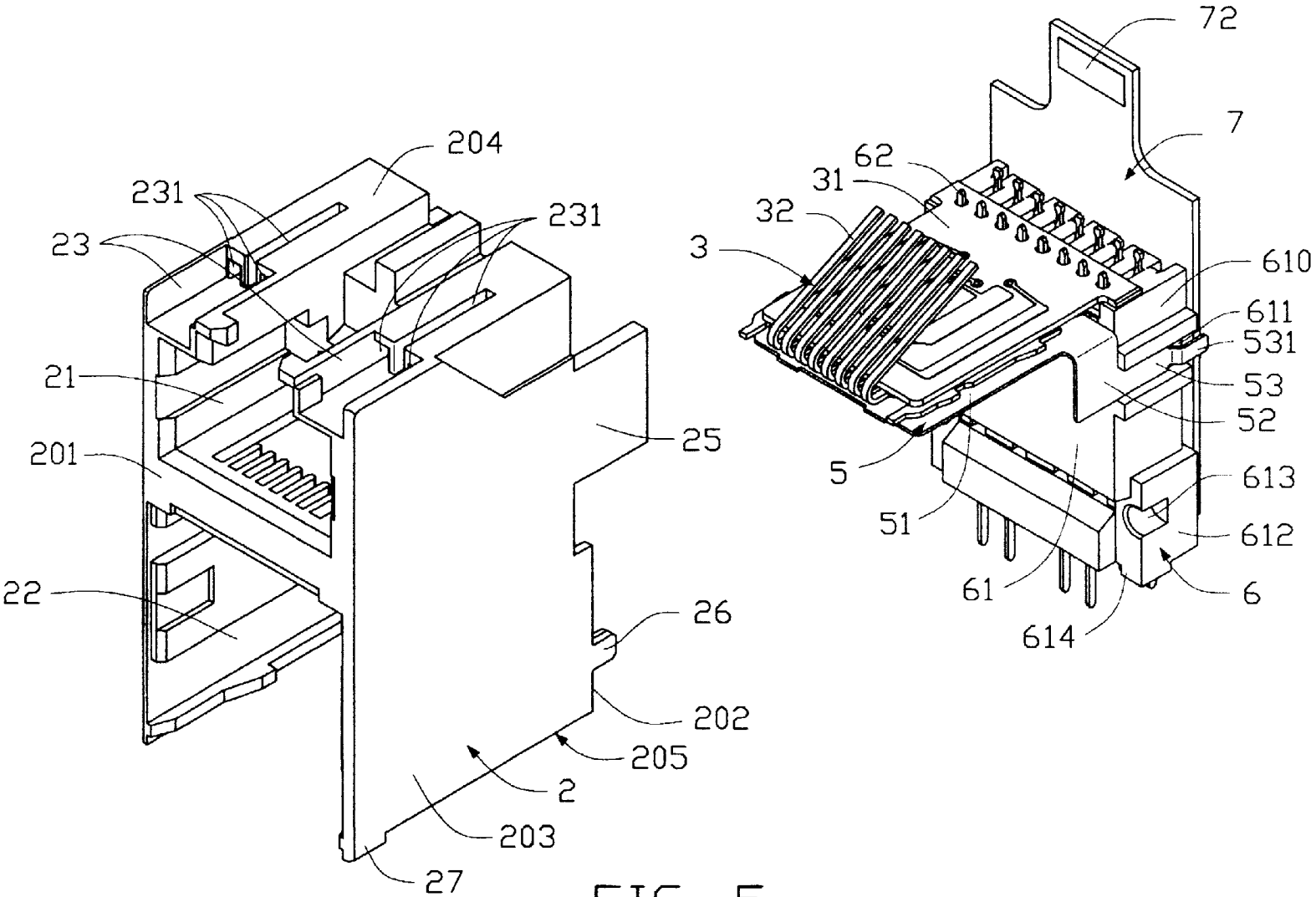
FIG. 5 is a partially view of the electrical connector assembly, showing the main housing, a contact module, a ground member, a magnetic module and a daughter printed circuit board (PCB) of the electrical connector assembly.

Referring to FIGS. 4 and 5, the main housing 2 is mounted on a mother printed circuit board (not shown, PCB) of an electrical device. The main housing 2 is substantially cuboidal and comprises a front and rear walls 201, 202, opposite sidewalls 203, a top wall 204 and a bottom wall 205. The main housing 2 defines an upper cavity 21 and a lower cavity 22. The upper cavity 21 is defined through the front and the rear walls 201, 202 for receiving the contact module 3. The lower cavity 22 is defined through the front, the rear and the bottom walls 201, 202, 205 for receiving the stacked USB connector 4. A comb portion 210 depends downwardly from the top wall 204 and extends into the upper cavity 21. The comb portion 210 defines a plurality of parallel retaining slits 211 communicating with the upper cavity 21. A pair of spaces 23 are defined in opposite side portions of the front and the top walls 201, 204. A pair of groups of three channels 231 are respectively defined through the rear wall 202 and communicate with corresponding spaces 23. A pair of mating holes 24 are defined in the rear wall 202 adjacent to corresponding three channels 231 for fixing the rear cover 10. Each sidewall 203 comprises a flange 25 projecting rearwardly from an upper portion and beyond the rear wall 202. Each flange 25 defines a notch 251 in a lower portion of an inner face thereof. A pair of semicylindric retaining posts 26 project rearwardly from side portions of a lower portion of the rear wall 202. The retaining posts 26 align with corresponding flanges 25 with cylindrical surfaces thereof face to each other. Each retaining post 26 has an inwardly projecting ridge 261 extending longitudinally along the cylindrical surface thereof. A pair of stand-offs 27 downwardly project from the bottom wall 205 for mounting on the mother PCB of the electrical device.

The contact module 3 is received in the upper cavity 21 and comprises a horizontal compensation PCB 31 and a plurality of parallel conductive terminals 32 mounted on the compensation PCB 31. Each terminal 32 comprises an elongate solder section 321 soldered to a bottom surface of the compensation PCB 31, and a spring engaging section 322 inclinedly extending above a top surface of the compensation PCB 31 with a free end thereof retained in a corresponding retaining slit 211 of the main housing 2. The stacked USB connector 4 is received in the lower cavity 22 of the main housing 2.

Figure 6:
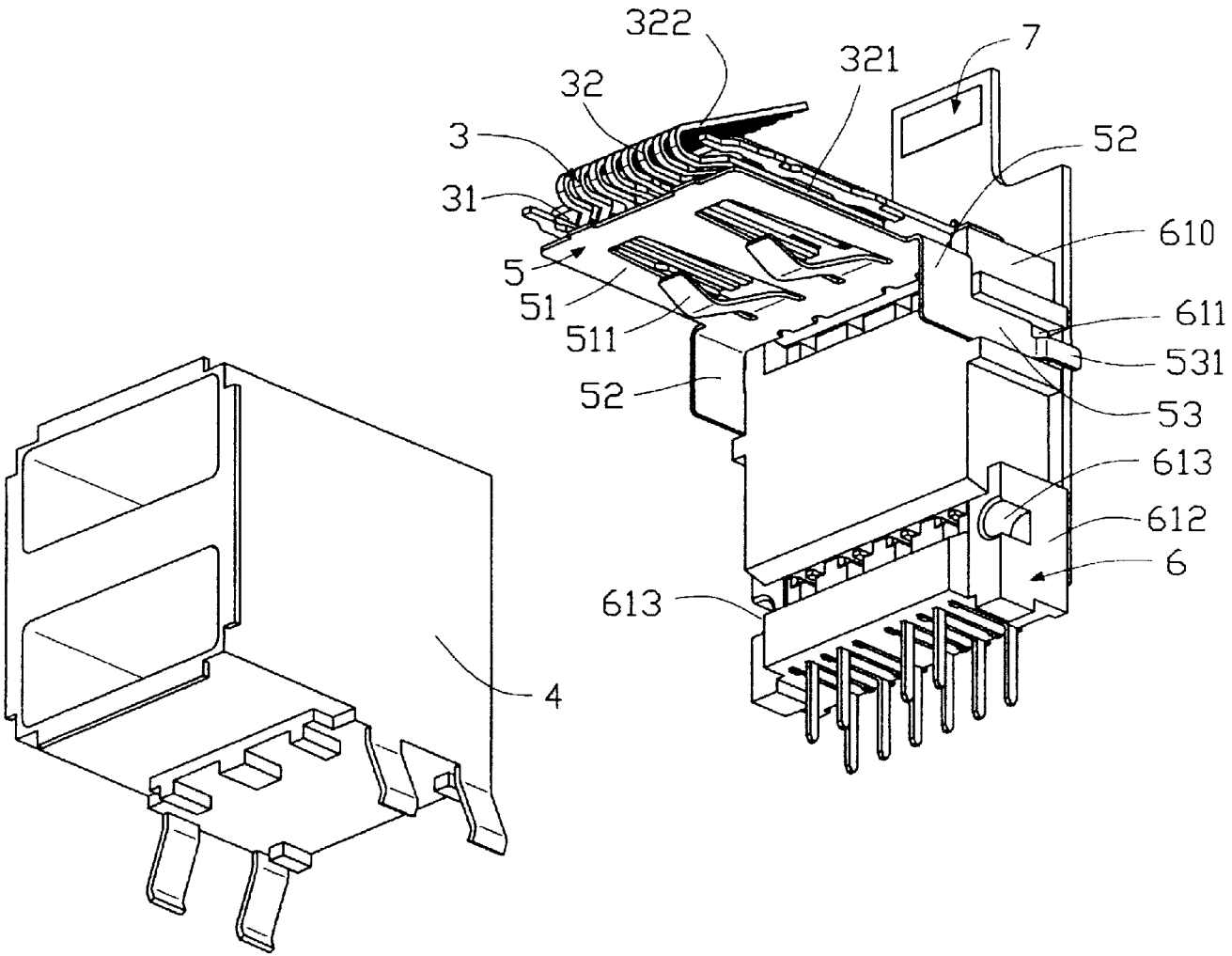
FIG. 6 is another partially view of the electrical connector assembly, showing the contact module, the ground member, the magnetic module, the daughter PCB and a stacked Universal Serial Bus (USB) connector of the electrical connector assembly.
Figure 7:
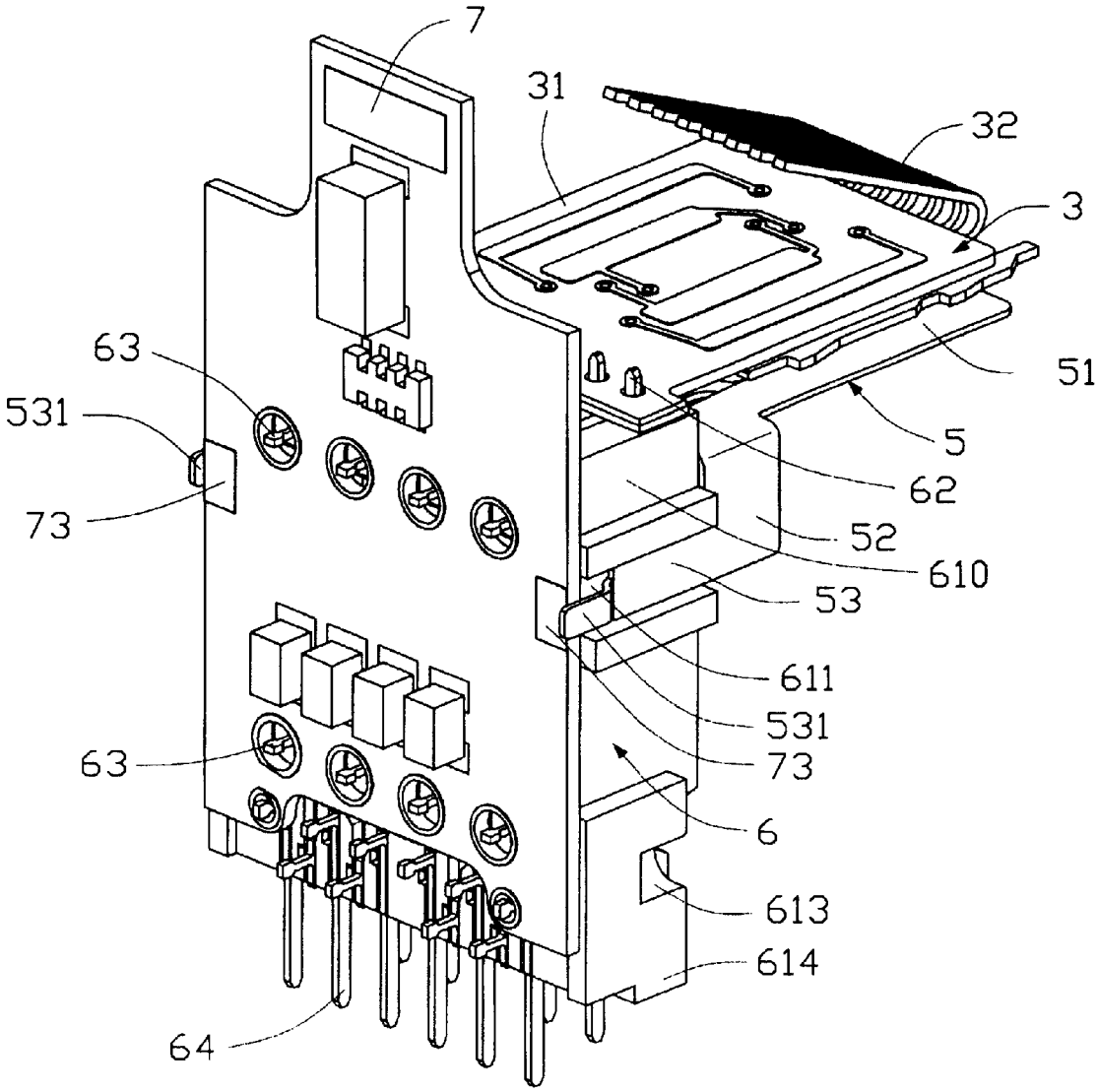
FIG. 7 is a further view of the electrical connector assembly, showing the contact module, the ground member, the magnetic module and the daughter PCB of the electrical connector assembly.

Referring to FIGS. 6 and 7, the ground member 5 is fabricated from a conductive metal sheet and comprises a rectangular body portion 51, a pair of upright linking portion 52 downwardly depending from rear portions of opposite side edges of the body portion 51 and a pair of solder portions 53 rearwardly extending from rear edges of corresponding linking portions 52. The body portion 51 is stamped out a pair of spring fingers 511 with free ends substantially extending forwardly and downwardly. The body portion 51 is inserted in the lower cavity 22 with spring fingers 511 elastically abutting against an upper face of the stacked USB connector 4. A solder tail 531 extends slightly and outwardly from a rear portion of each solder portion 53 beyond the daughter PCB 7.

Figure 8:
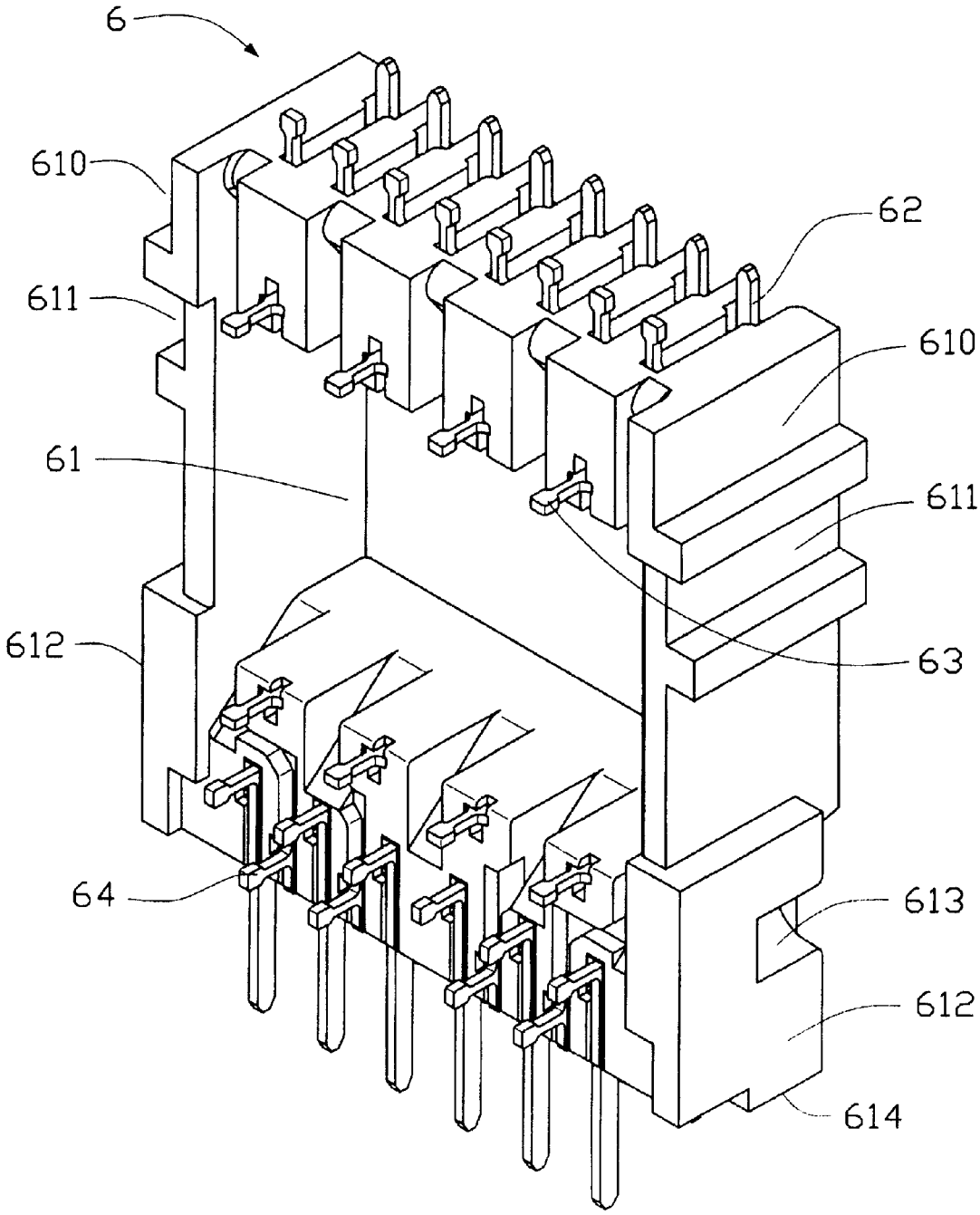
FIG. 8 is a perspective view of the magnetic module of the electrical connector assembly.

Referring to FIGS. 7 and 8, the magnetic module 6 is mounted onto the rear wall 202 of the main housing 2 and comprises an insulative receptacle portion 61, a plurality of first, second and third contacts 62, 63 and 64 retained by the receptacle portion 61. The receptacle portion 61 is substantially cubic and receives a plurality of magnetic coils (not shown) interconnecting the first, the second and the third contacts 62, 63 and 64 in a certain manner.

A pair of recesses 610 are respectively defined in an upper portion of opposite sidewalls 612 of the receptacle portion 61 for facilitating engaging with the notches 251 of the main housing 2, thereby retaining the magnetic module 6 on the main housing 2. The receptacle portion 61 horizontally defines a pair of grooves 611 in a middle portion of corresponding opposite sidewalls 612 for retaining corresponding solder portions 53 of the ground member 5 therein. A pair of semicylindric retaining cutouts 613 are respectively defined in lower portions of the sidewalls 612. The retaining cutouts 613 expose forwardly for engaging with corresponding retaining posts 26 of the main housing 2, whereby the magnetic module 6 is mounted on the main housing 2. A pair of stand-offs 614 downwardly extend from a bottom surface of the receptacle portion 61 for mounting on the mother PCB.

The first contacts 62 extend beyond a top surface of the receptacle portion 61 to electrically connect with the compensation PCB 31 of the contact module 3. The second contacts 63 project from a rear surface of the receptacle portion 61 to electrically connect with the daughter PCB 7. The third contacts 64 project beyond a bottom surface of the receptacle portion 61 to solder to the mother PCB.

Particularly referring to FIGS. 6 and 7, the daughter PCB 7 is mounted on a rear surface of the receptacle portion 61 of the magnetic module 6 and carries a plurality of signal conditioning components 71 on a rear surface thereof for eliminating undesirable extraneous signals such as high frequency noises. A pair of contact pads 72 are attached on top portions of opposite surfaces of the daughter PCB 7. A pair of solder pads 73 are formed on side portions of the rear surface of the daughter PCB 7 and are soldered with the solder tails 531 of the ground member 5. Therefore, a continuous ground connection is established between the stacked USB connector 4 and the daughter PCB 7.

Figure 9:
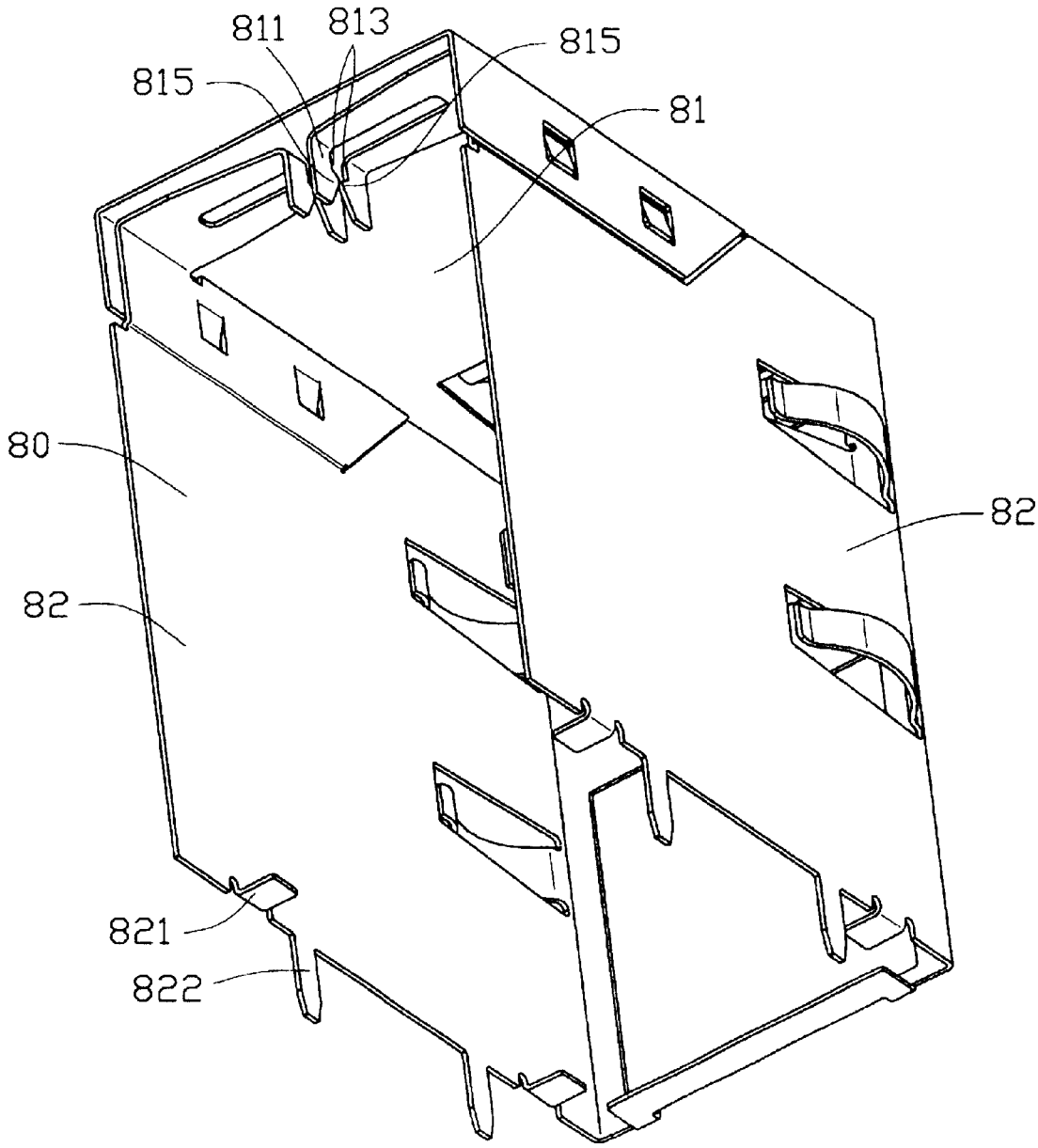
FIG. 9 is a perspective view of a shield of the electrical connector assembly.

Referring to FIGS. 3 and 9, the shield 8 comprises a top wall 81 and opposite side walls 82. A chamber 80 is defined by the top wall 81 and the side walls 82 for substantially enclosing the main housing 2, the magnetic module 6 and the daughter PCB 7. The top wall 81 comprises an upper layer (not labeled) and a lower layer (not labeled). Two pairs of contacting legs 811 depend downwardly from a rear portion of the lower layer of the top wall 81 and are arranged in two juxtaposed lines. Each pair of contacting legs 811 is parallel to the side walls 82 of the shield 8 with inner side edges 813 facing to each other. A pair of contacting feet 815 are respectively formed on the inner side edges 813 of each pair of contacting legs 811 and project to each other for securely clamping the upper portion of the daughter PCB 7 therebetween, thereby electrically contacting corresponding contact pads 72 of the daughter PCB 7. Each side wall 82 forms a pair of downwardly projecting mounting legs 822 for soldering to ground traces of the mother PCB. Therefore, a continuous ground connection is established between the daughter PCB 7 and the mother PCB. Each side walls 82 also forms a pair of retention tabs 821 inwardly bent to abut against the bottom wall 205 of the main housing 2 for retaining the shield 8 with the main housing 2.

Referring to FIG. 1, the LEDs 9 are respectively received in the spaces 23 of the main housing 2 with tails 91 rearwardly extending through corresponding channels 231.

The rear cover 10 comprises a pair of forwardly projecting mating poles 101 for engaging with the mating holes 24 of the main housing 2 and a plurality of contacts 102 extending forwardly to electrically connect with corresponding tails 91 of the LEDs 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mounting on a mother printed circuit board (PCB) of an electrical device, comprising:

an insulative main housing comprising a front wall and a rear wall, the main housing defining a cavity through the front and the rear walls;

a contact module received in the cavity of the main housing and comprising a plurality of conductive terminals;

a daughter printed circuit board (PCB) adjacent to the main housing and electrically connecting to the conductive terminals of the contact module;

a shield substantially enclosing the main housing and the daughter PCB; and an electrical connection device arranged between the daughter PCB and the shield, thereby establishing electrical connection between the daughter PCB and the shield.

2. The electrical connector as claimed in claim 1, wherein the electrical connection device comprises a contact pad formed on the daughter PCB and a contacting leg projecting from the shield to electrically connect with the contact pad.

3. The electrical connector as claimed in claim 2, wherein the contacting leg of the shield forms a contacting foot projecting to the contact pad of the daughter PCB, thereby reliably contacting the corresponding connect pad.

4. The electrical connector as claimed in claim 2, wherein the contact pad of the daughter PCB is formed on an upper portion of the daughter PCB, and wherein the contacting leg of the shield extends downwardly from a top wall of the shield to electrically connect the contact pad of the daughter PCB.

5. The electrical connector as claimed in claim 2, wherein the daughter PCB is substantially parallel to the rear wall of the main housing, and wherein the contacting leg is substantially perpendicular to the daughter PCB.

6. The electrical connector as claimed in claim 2, wherein the main housing comprises a sidewall perpendicular to the rear wall, the contacting leg substantially parallel to the sidewall of the main housing.

7. The electrical connector as claimed in claim 1, wherein the electrical connection device comprises a pair of contact pads formed on opposite faces of the daughter PCB, and a pair of contacting legs projecting from the shield to clamp the daughter PCB on corresponding contact pads, thereby establishing electrically connection therebetween.

8. The electrical connector as claimed in claim 1, wherein the shield comprises a downwardly projecting mounting leg adapted for soldering to the mother PCB of the electrical device.

9. The electrical connector as claimed in claim 1, wherein the shield comprises a tab bent therefrom to abut against the main housing.

10. The electrical connector as claimed in claim 1, comprising a magnetic module sandwiched between the main housing and the daughter PCB.

11. The electrical connector as claimed in claim 10, wherein the contact module comprises a compensation PCB perpendicular to the daughter PCB, the conductive contacts soldered on the compensation PCB, and wherein the magnetic module comprises a plurality of first contacts electrically connecting the compensation PCB.

12. The electrical connector as claimed in claim 10, wherein the magnetic module comprises a plurality of second contacts, and wherein the daughter PCB defines a plurality of hole, through which the second contacts of the magnetic module are soldered to the daughter PCB.

13. The electrical connector as claimed in claim 10, wherein the magnetic module defines a retaining cutout therein, and wherein the main housing comprises a retaining post projecting therefrom to engage with the retaining cutout of the magnetic module.

14. An electrical connector adapted for mounting on a mother printed circuit board (PCB) of an electrical device, comprising:

an insulative main housing comprising opposite front and rear walls, the main housing defining a cavity through the front and the rear walls;

a contact module received in the cavity of the main housing and comprising a plurality of conductive terminals;

a daughter printed circuit board (PCB) assembled to the main housing and electrically connecting to the conductive contacts of the contact module;

a shield substantially enclosing the main housing and the daughter PCB therein and electrically connecting the daughter PCB; and a Light Emitting Diode (LED) secured by the main housing.

15. The electrical connector as claimed in claim 14, wherein the daughter PCB comprises a contact pad formed thereon, and wherein the shield comprises a contacting leg projecting therefrom to electrically connect with the contact pad.

16. The electrical connector as claimed in claim 14, comprising a rear cover attached to the main housing.

17. The electrical connector as claimed in claim 16, wherein the rear cover comprises a conductive contact retained therein electrically connecting the LED.

18. The electrical connector as claimed in claim 14, wherein at least a pair of contacting legs integrally extending from said shield and clamping said daughter board in front-to-back direction.

19. An electrical connector comprising:

an insulative housing defining upper and lower cavities;

a sub-connector being assembled into the lower cavity;

a daughter board vertically positioned on a rear portion of the housing;

a contact module horizontally extending perpendicular to the daughter board and inserted into the upper cavity;

a ground member horizontally extending perpendicular to the daughter board under the contact module and inserted into the lower cavity and contacting the sub-connector; and a metallic shield enclosing the housing and directly mechanically and electrically connecting to the daughter board.

20. The electrical connector as claimed in claim 19, wherein said ground member is fixedly soldered to the daughter board.

* * * * *